US005934393A

United States Patent [19]

Marshall

[11] Patent Number: 5,934,393

[45] Date of Patent: Aug. 10, 1999

[54] CORE BARREL APPARATUS

[75] Inventor: John C Marshall, North Bay, Canada

[73] Assignee: Boart Longyear International Holdings, Inc., Salt Lake City, Utah

[21] Appl. No.: 08/802,557

[22] Filed: Feb. 19, 1997

[51] Int. Cl.[6] ..... E21B 25/02

[52] U.S. Cl. ..... 175/236; 175/246

[58] Field of Search ..... 175/236, 239, 175/243, 246, 247, 244

[56] References Cited

U.S. PATENT DOCUMENTS

| | | | |
|---|---|---|---|
| 3,103,981 | 9/1963 | Harper | 175/243 |
| 3,126,064 | 3/1964 | Miller | 175/246 |
| 3,305,033 | 2/1967 | Pickard et al. | 175/246 |
| 3,333,647 | 8/1967 | Karich et al. | 175/247 |
| 3,340,939 | 9/1967 | Lindelof | 175/246 |
| 4,800,969 | 1/1989 | Thompson | 175/246 |
| 5,020,612 | 6/1991 | Williams | 175/234 |
| 5,325,930 | 7/1994 | Harrison | 175/246 |
| 5,339,915 | 8/1994 | Laporte et al. | 175/244 |

FOREIGN PATENT DOCUMENTS

| | | | |
|---|---|---|---|
| 2138201 | 6/1996 | Canada . | |
| 1148390 | 1/1987 | U.S.S.R. | 175/246 |

*Primary Examiner*—David J. Bagnell
*Attorney, Agent, or Firm*—Clayton R. Johnson

[57] ABSTRACT

The core barrel apparatus includes a wire line core barrel inner tube having a latch body main body portion and an inner portion threaded together to cooperatively provide a radial outer groove mounting a landing ring seatable on the drill string landing ring with the latches seatable in the drill string latch seat and a radial inner groove mounting a bushing surrounding the axial bore of the bypass channel for bypassing fluid between portions of the latch body on axial opposite sides of the latch body ring. The valving mechanism in the bore includes the bushing and may include a valve spring axially inwardly of bushing and a valve ball. The valve ball and bushing may be of a resiliency to permit the ball passing through the bushing under fluid pressure or prevent the ball passing through the bushing. Overcenter linkage connected to the latches is retractable by a retractor pin. In one embodiment the inner tube assembly may be of a fast descent type lowerable in a drill string by an overshot assembly having pulling dogs that remain in a coupled relationship to the inner tube assembly spearpoint until the latches move to their latch seated position and the dogs are forced by the spearpoint to a release position and thence the overshot release tube moves to retain the dogs in their release position and a second embodiment of an underground type.

26 Claims, 8 Drawing Sheets

CORE BARREL APPARATUS

BACKGROUND OF THE INVENTION

The present invention relates to drilling apparatus and more particularly to valving mechanism for controlling fluid flow from one axial side of a latch body landing shoulder to the other and for forming a fluid seal with the drill string to permit the apparatus being fluidly propelled to the bit end of a drill string.

U.S. Pat. No. 5,325,930 to Harrison discloses a toggle linkage movable to a overcenter position for locking the latches in a latch seated position and for retracting the latches.

U.S. Pat. No. 5,339,915 to Laporte et al discloses a one way retention valve in a core barrel inner tube assembly that functions to retain drilling liquid pressure in lost circulation situations resulting from, for example, drilling into a cavity or into a broken earth formation. However, with such apparatus, the descent in a drill string is very slow since the fluid bypass channel is blocked and liquid can not bypass except around the exterior of the latch body landing shoulder. Further, a heavy duty spring is used to create a high liquid pressure and retain a column of liquid above the core barrel inner tube assembly. This high pressure in combination with pump surging has resulted in wear on the valve ball seat. The ball essentially hammers the seat which, over a period of time, damages the seat.

U.S. Pat. No. 5,020,612 to Williams discloses a core barrel inner tube assembly having a resilient ring (bushing) in the fluid bypass channel through which a valve ball is forced by fluid under pressure when the inner tube assembly is in its core collecting position at the bit end of the drill string.

U.S. Pat. No. 3,333,647 to Karich et al discloses a core barrel inner tube assembly having spring mechanism acting between a latch body and a latch release tube to constantly urge the latch release tube to a position permitting the latches moving to a latch seated position.

In order to make improvements in fluid bypass valving mechanism, latching mechanism and/or mechanism for incorporation in drilling apparatus to facilitate fluidly propelling a drilling tool to the bit end of a drill stringthat includes, for example, wire line core barrel tube assemblies, retractable drag bits and earth sampling tubes that are retractable through a drill string and/or an outer barrel, this invention has been made.

SUMMARY OF THE INVENTION

A drilling assembly that is movable in a drill string to the inner end portion thereof for being latchingly retained therein includes a latch body having latch retracting mechanism mounted thereon for limited axial movement relative thereto for retracting the latches of the latch assembly from a latch seated position. The latch body is of a two part construction with each latch body part defining a part of a fluid bypass channel having a chamber in which there can be removably mounted one or more of a valve ball, a resilient bushing through which a valve ball can be pushed under a preselected high fluid pressure, and an annular plug threaded in a latch body part for a valve spring to seat against, depending upon the valving arrangement desired. One embodiment of a core barrel inner tube assembly is fluidly propellable to the bit end of the drill string regardless of the drilling direction and spring mechanism is mounted to resiliently urge a latch retractor tube to move toggle link latch mechanism to an overcenter locked, latch seated position. In another embodiment, the inner tube assembly is lowerable by an overshot assembly which can not release the inner tube assembly until the latches move to a latch seated position. A drilling tool is attached to the latch body to extend inwardly thereof, the tool being any one of, for example, a core barrel inner tube, a plug bit, an earth sampling tube, and etc.

One of the objects of this invention is to provide new and novel means in a core barrel inner tube assembly that will result in a high pressure signal being obtained at the drilling surface when said assembly has landed on the drill string landing shoulder and is in a position for latchingly engaging the drill string latch seat. A different object of this invention is to provide, in a core barrel inner tube assembly, new and novel latch body mechanism permitting removably mounting selected valving components in the latch body fluid bypass channel in accordance with the desired fluid pressure required for fluid to bypass the drill string landing ring. Another object of this invention is to provide new and novel valving mechanism in the latch body fluid bypass channel. In furtherance of the last mentioned object, it is an additional object of this invention to provide a new and novel mounting of valving mechanism and latch body landing ring in an inner tube assembly.

For purposes of facilitating the description of the invention, the term "inner" refers to that portion of the drill string, or of the assembly, or an element of the assembly being described which in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described which in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

Figure 1A:
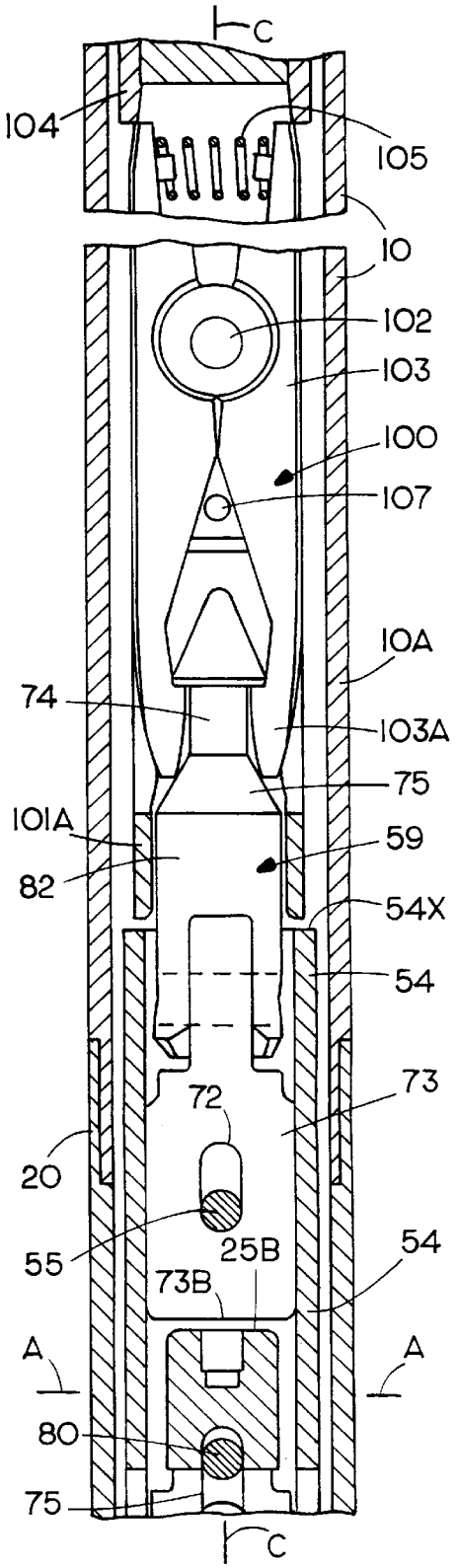
FIGS. 1A and 1B one arranged above the other with the axial center lines aligned and lines A—A and B—B of FIGS. 1A and 1B aligned, form a composite longitudinal section through the drilling apparatus of the first embodiment of the invention axially spaced from the bit end of a drill string in a bore hole, other than the axial inner portion of the core barrel inner and outer tube assemblies are not shown and axial intermediate portions are broken away.

Referring now in particular to FIGS. 1A, 1B, 2A, 2B, 2C and 9, there is illustrated a hollow drill string 10 which is made up of a series of interconnected hollow drill rods (tubes). The drill string 10 is in a downwardly extending bore hole 12 drilled in rock or other types of earth formations by means of an annular core bit 11. The pump apparatus indicated by block 84 pumps fluid under pressure through line 88 into the outer end of the drill string 10 in a conventional manner, the illustrated part of the drill string 10 in FIG. 1 being located just upstream of the bit in the bore hole 12 and may be at a considerable depth below the surface.

The portion of the drill string attached to or extended below the pipe (rod) section 10A is commonly referred to as a core barrel outer tube assembly, generally designated 13, the core barrel outer tube assembly being provided for receiving and retaining the core barrel inner tube assembly, generally designated 15, adjacent to the bit end of the drill string. Details of the construction of the core barrel outer tube assembly used in this invention may be of the general nature such as that disclosed in U.S. Pat. Nos. 3,120,282 and 3,120,283. The outer tube assembly is composed of an adaptor coupling 21 that is threadedly connected to the core barrel outer tube 18 to provide a recess in which a landing ring (drill string landing shoulder) 27 is mounted, a reaming shell 19 connected to the inner (lower) end of tube 18 and an annular drill bit 11 at the inner end of the reaming shell for drilling into the earth formation from which the core sample is taken. The outer end of the assembly 13 includes a locking coupling 20 that connects the adaptor coupling to the adjacent pipe section 10A of the drill string. At the opposite end of the coupling 20 from the pipe section 10A, the locking coupling in conjunction with the annular recess of the coupling 21 form a latch seat 21A inside of the surface of the adaptor coupling against which the latches 47, 48 of the latch assembly L are seatable for removably retaining the core barrel inner tube assembly 15 adjacent to the core bit. The inner end portion of the locking coupling may have a conventional projection flange (not shown) which extends as a partial cylindrical surface more closely adjacent to the core bit than to the main part of said coupling. This flange bears against a latch to cause the latches and other portions of the inner tube assembly to rotate with the drill string when the latches are in a latched position as is conventional.

The core barrel inner tube assembly 15 includes a latch body, generally designated 25, having a main body portion 44 with a conventional annular, downwardly facing shoulder 30 and an inner body portion 43, the main body portion having an inner, reduced outer diameter part 44A extended into and threadedly connected to the inner body portion axial outer annular part 43A. Parts 43A and 44A cooperatively provide a radially outward annular groove to removably mount a latch body ring 24 that is seatable on the landing ring 27. The latch body ring 24 is retained in abutting relationship to shoulder 30 and shoulder 43B, the shoulder 43B in part defining the groove in which the ring 24 is retained (see FIG. 9). Thus, the latch body ring provides a latch body shoulder that is seatable on the drill string shoulder which is provided by the landing ring 27.

The latch body portions 43 and 44 cooperatively provide a fluid bypass channel F having inlet ports 52 opening to an axial bore 57 inwardly of the bore outer end and outwardly of the shoulder 30, and outlet ports 53 that open to the bore 57 axially inwardly of the resilient bushing 49 and outwardly of the inner terminal edge of the inner body portion. The bushing constitutes part of a two way liquid retention valve mechanism, generally designated 40, for controlling fluid flow through the latch body bypass channel. The bushing is removably retained in the radial internal groove that is defined by the inner transverse annular terminal edge 45 of the main body portion part 44, the inner peripheral annular wall portion 43X of the inner body part with which the outer peripheral wall of the bushing is abuttable and an axially outwardly facing shoulder 50 of the inner body portion 43 with the shoulder 50 being axially between the ports 53 and the main body portion part 44A. The minimum inner diameter of the bushing when mounted in the groove is substantially smaller than the minimum inner diameter of the bore axially intermediate the ports 52 and 53.

The fluid bypass channel F permits fluid flow to bypass the landing ring 27 and the latch body ring 24 when the ring 24 is seated on the ring 27. That is, the portions of the inner tube assembly from the latch body ring 24 and axially inwardly and outwardly of ring 24 are of a smaller maximum diameter than the maximum outer diameter of ring 24 while the channel has ports 52 opening exterior of the latch body axially outwardly of the ring 24 to the annular clearance space outwardly of the ring 24 and radially between the latch body and the drill string and second ports 53 opening exterior to the annular clearance space axially inwardly of the ring 24 and radially between the latch body and the drill string. The latch body landing ring when seating on the drill string landing ring blocks or severely restricts axial inward flow therebetween.

The axial inner end portion 57A of bore 57, which is in latch body inner portion 43, extends axially from the axial inner terminal edge of latch body portion 43 to the axially inwardly facing shoulder 93 formed at its intersection with the reduced diameter bore portion 57B of latch body portion 43 is threaded. Shoulder 93 is located axially inwardly of the ports 53. Threaded into bore portion 57B to abut against shoulder 93 is an annular plug 97. A coil spring 98 is provided in bore 57 to have one end seated against the annular plug and an opposite end either closely adjacent to or in abutting relationship to the bushing 49.

Figure 1B:
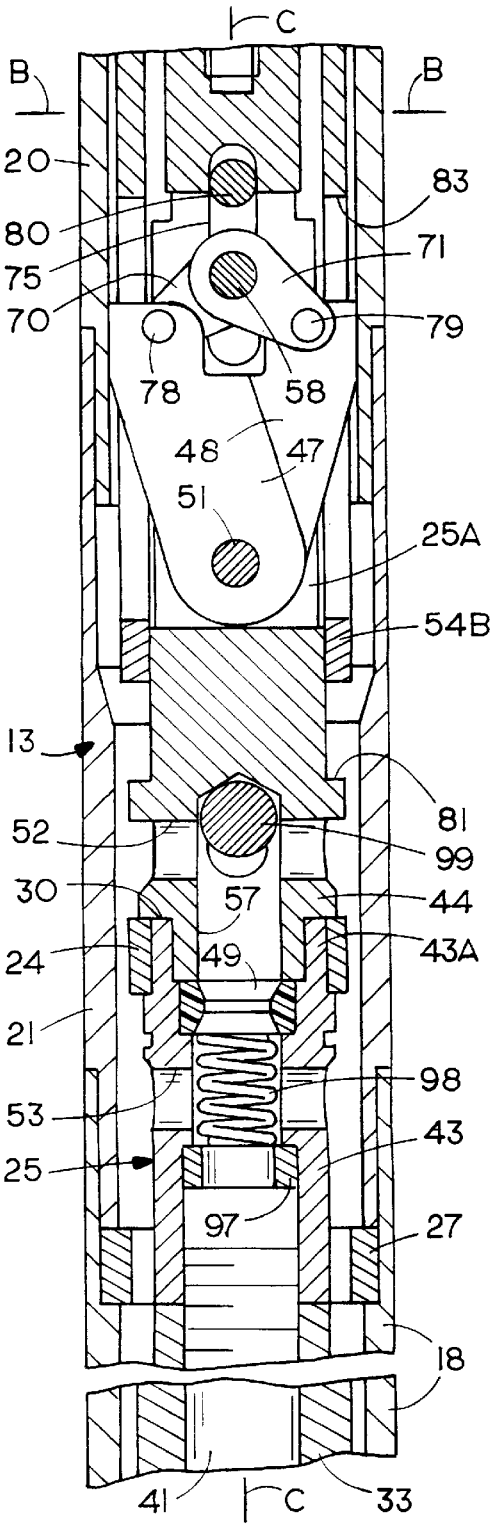
Figure 10:
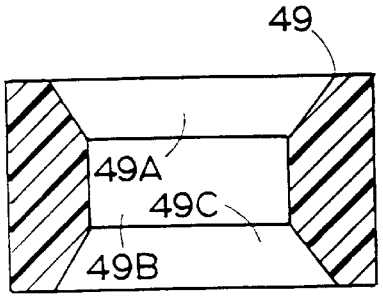
FIG. 10 is an enlarged cross sectional view of the bushing of the first embodiment.

Mounted in the bore 57 is a valve ball 99 that is axially movable in the bore to an axially outer position that is at least in part axially outwardly of the inlet ports 52 such as shown in FIG. 1B to permit fluid flow from the clearance space between the latch body and drill string and into ports 53 and through the bypass channel to permit rapid axial movement of the core barrel inner tube assembly to the bit end of the drill string. Further, the ball is seatable on the axial outer frustoconical portion (axially outwardly facing valve seat) 49A of the bushing 49 to block fluid flow through the bypass channel in an axial direction from the inlet ports 52 to the outlet ports until the pumped in fluid pressure exceeds a preselected level, but not in the opposite direction. The valve ball in seating against the bushing portion 49A as indicated in the preceding sentence provides a landing indicator (high pressure) signal at the drilling surface to indicate the latch body landing ring is seated on the drill string ring. The valve ball and the bushing axial intermediate (minimum diameter) portion 49B are of diameters and the bushing is of a resiliency that the valve ball will not pass through the bushing until after a preselected fluid pressure has been exerted on the ball with the core barrel inner tube assembly seated on the landing ring 27 and then the ball passes through the bushing to abut against the spring 98 (see FIGS. 9 and 10). After the ball has passed through the bushing the spring may retain the ball in abutting relationship to the frustoconical inner end portion (axially inwardly facing valve seat) 49C to block fluid flow through the bypass channel until fluid under pressure at the inlet ports 52 is at a second preselected pressure that is greater than that required to force the ball through the bushing if it is desired to maintain a preselected head of fluid pressure in the drill string axially outwardly of the landing ring 27 to reduce chance of blockage from lost circulation, or the spring may be of characteristics such the fluid pressure required to move the ball relative to bushing portion 47B to permit fluid bypass is less than that required to push the ball through the bushing. The choice of the characteristics of the spring 98 used depends on the characteristics of the earth formation from which a core sample is being obtained. A landing indicator signal can be obtained by using the same bushing, but a larger diameter ball which will not pass axially inwardly through the bushing and the use of the spring can be dispensed with.

The assembly 15 also includes a core receiving tube 31, an inner tube cap 33 threaded into the outer end of the core receiving tube, and a spindle and bearing subassembly 41 for connecting the cap to the inner portion of the latch body. The subassembly 41 includes a spindle bolt 41A threadedly connected to the inner end portion of the latch body, and connects the cap to the latch body for limited movement in a conventional manner. The core receiving tube has a replaceable core lifter case 34 and a core lifter 35, the structure and function of which may be generally the same as set forth in U.S. Pat. No. 2,829,868. A fluid passageway 39 formed in the cap 33 opens through a valve subassembly 38 to the interior of the outer end of the core receiving tube and at the opposite end to the annular clearance space 37 between the inner tube assembly and the outer tube 18 that forms a part of the annular fluid channel 37 to, in conjunction with the bypass channels, permit fluid to bypass the inner tube assembly when in a core taking position such as illustrated in FIG. 2C. The cap 33 is mounted by the spindle-bearing subassembly 41, the subassembly 41 and the manner of the mounting thereof being very similar to that described in greater detail in U.S. Pat. No. 3,305,033.

The core barrel inner tube assembly also includes a latch assembly L having a pair of latches 47, 48 with their axial inner end portions pivotally mounted in a latch body slot 25A by a pivot member 51 that is mounted to the latch body. A latch retractor (release) tube 54 is mounted by the latch body for limited axial movement relative thereto for retracting the latch assembly from its latch seated position to their latch release position in a manner set forth below and alternately permitting the latch assembly moving to its latch seated position when the latches are adjacent to the latch seat.

A pin 55 is fixedly mounted to the outer end portion of the latch retractor tube and is extended through an axially elongated slot 72 in the plug 73 of the overshot coupling device, generally designated 59. Thus, the plug 73 may be moved relative to the latch retractor tube to an axial inner position having its inner transverse surface 73B abut against the outer transverse surface 25B of the latch body. The device 59 includes a spearpoint 73 that is joined by a reduced diameter neck 74 to the minor base of the frustoconical portion 75. Even though the overshot coupling device 59 shown may be substantially the same construction as that described in U.S. Pat. No. 4,281,725 and functions in the same manner, it is to be understood that other overshot coupling devices can be used.

Figure 2A:
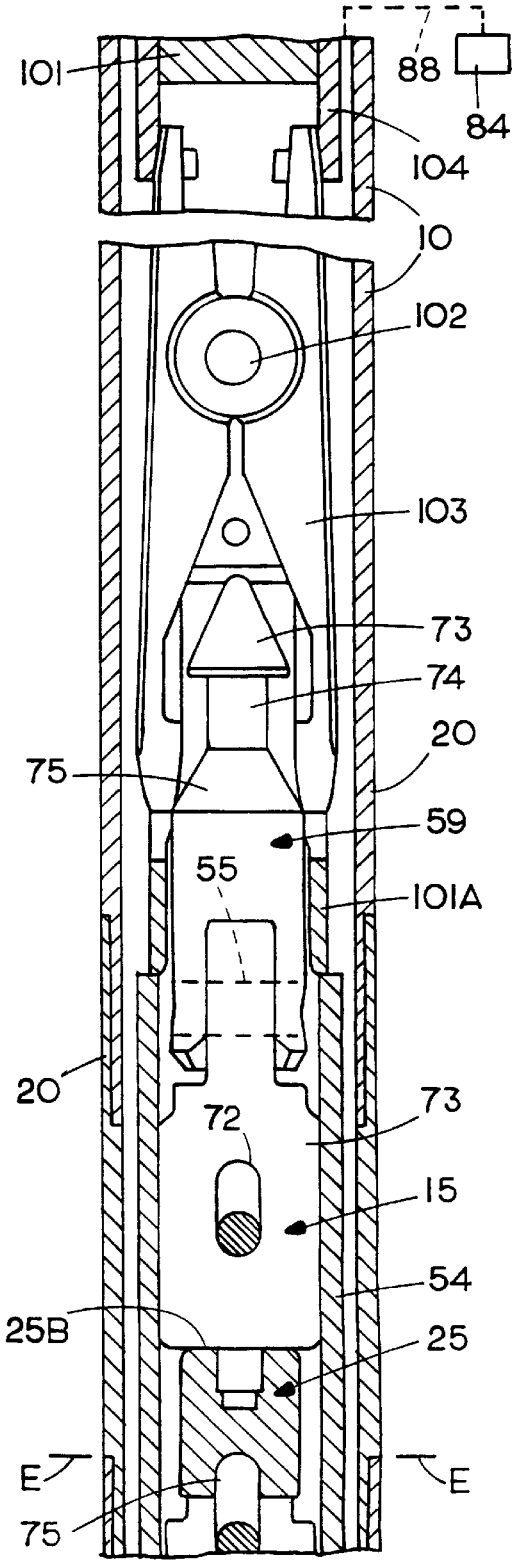
FIGS. 2A, 2B and 2C one arranged above the other with the axial center lines aligned and lines E—E and F—F of FIGS. 2A and 2B aligned, and lines G—G and H—H of FIGS. 2B and 2C aligned, form a composite longitudinal section through the drilling apparatus of the first embodiment of the invention at the bit end of a drill string in a bore hole with the latches and latch links shown as a side view with the latches being in a latch seated position and just prior to the overshot assembly being retracted and axial intermediate portions broken away.
Figure 2B:
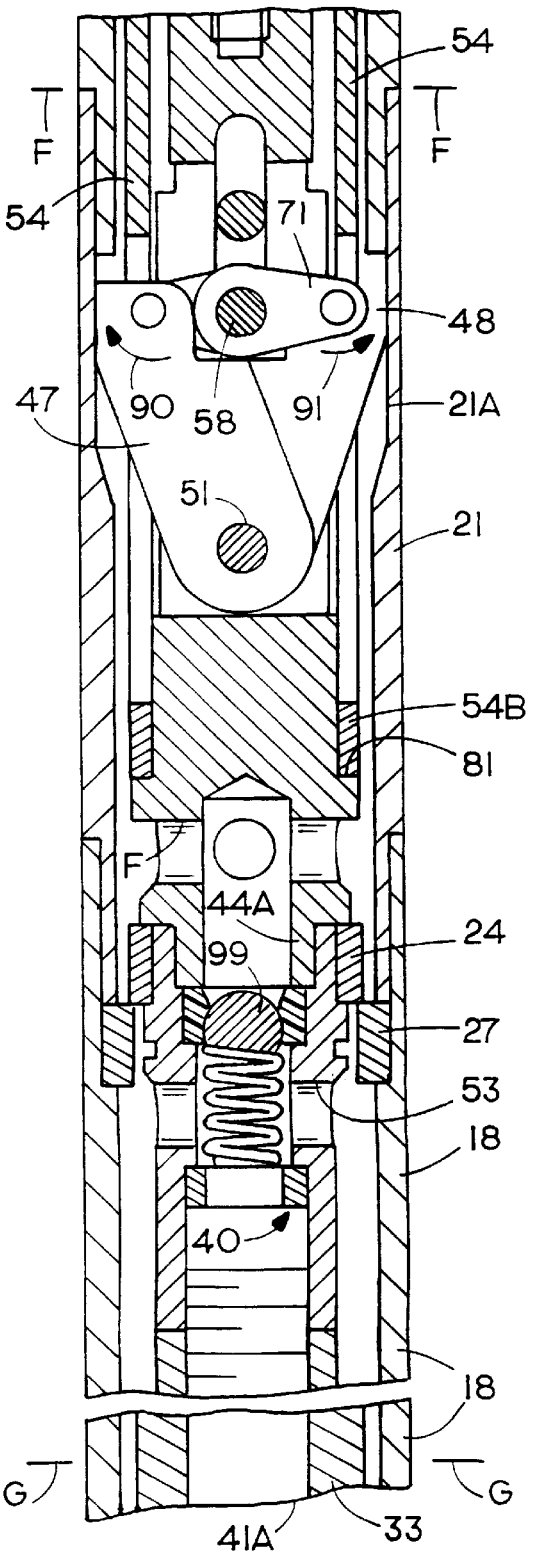
Figure 2C:
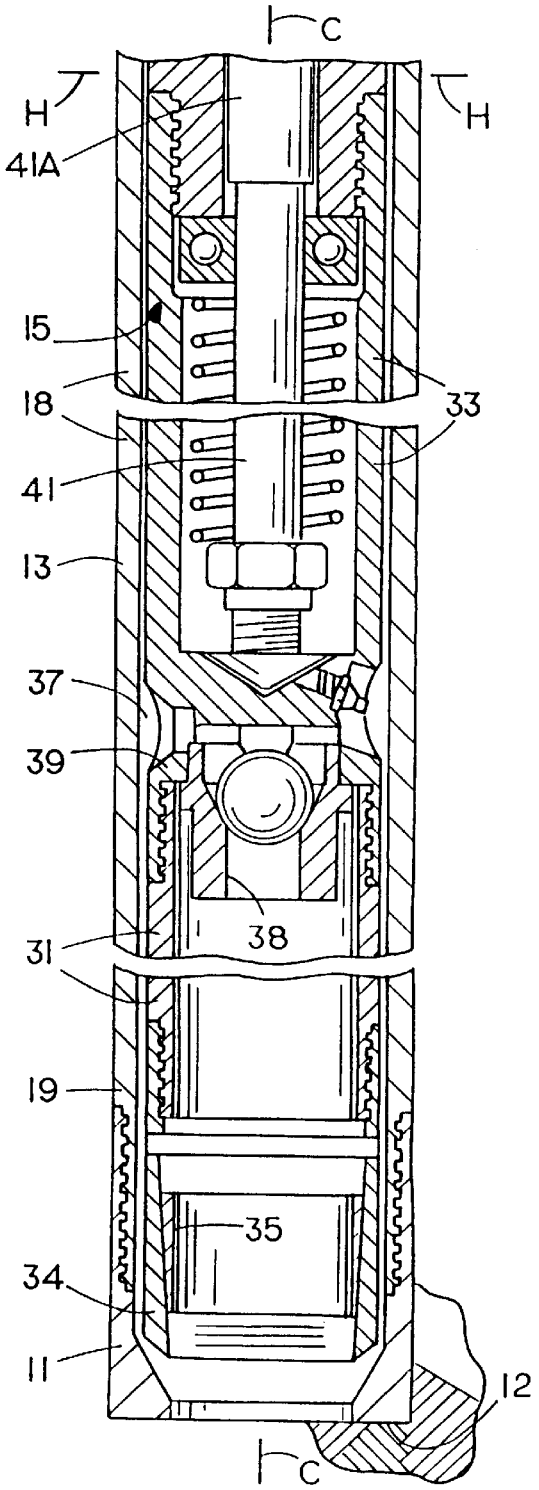
Figure 3A:
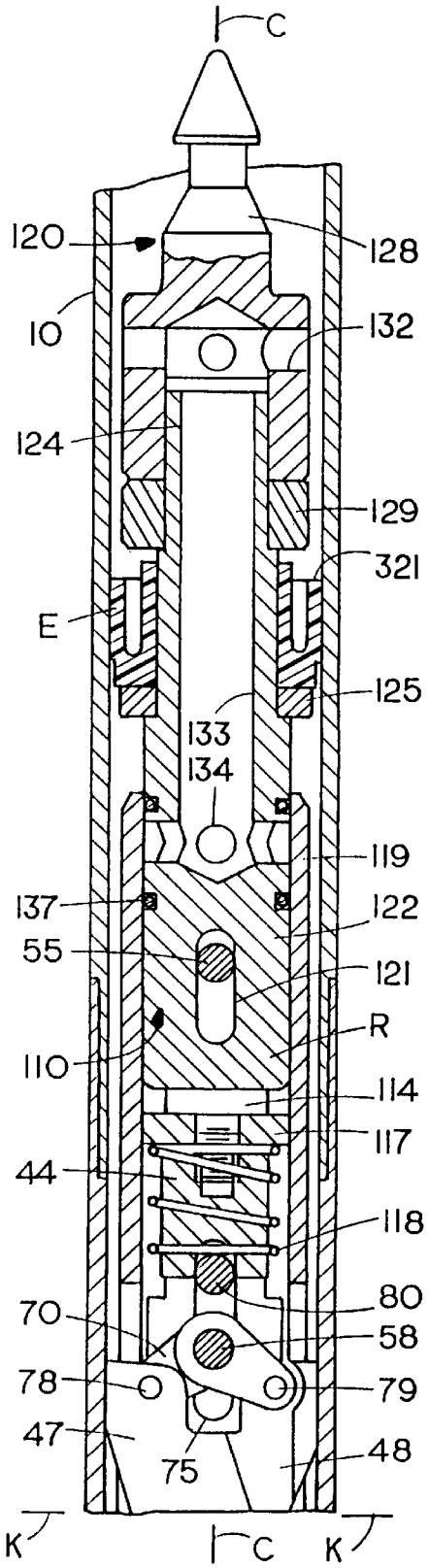
FIGS. 3A and 3B one arranged above the other with the axial center lines aligned and lines K—K and L—L of FIGS. 3A and 3B aligned form a composite longitudinal section through the axial outer end portion of the underground core barrel inner tube assembly of the second embodiment of the invention with the latch body landing ring axially spaced from the drill string landing ring a short distance.
Figure 3B:
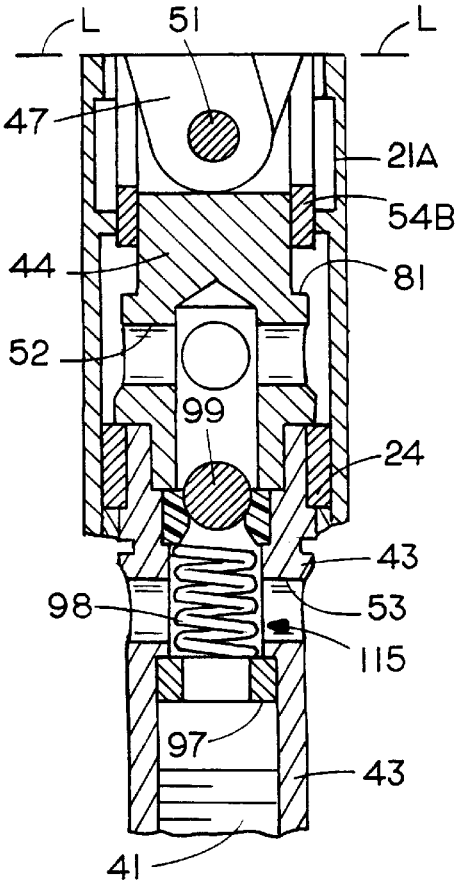
Figure 4A:
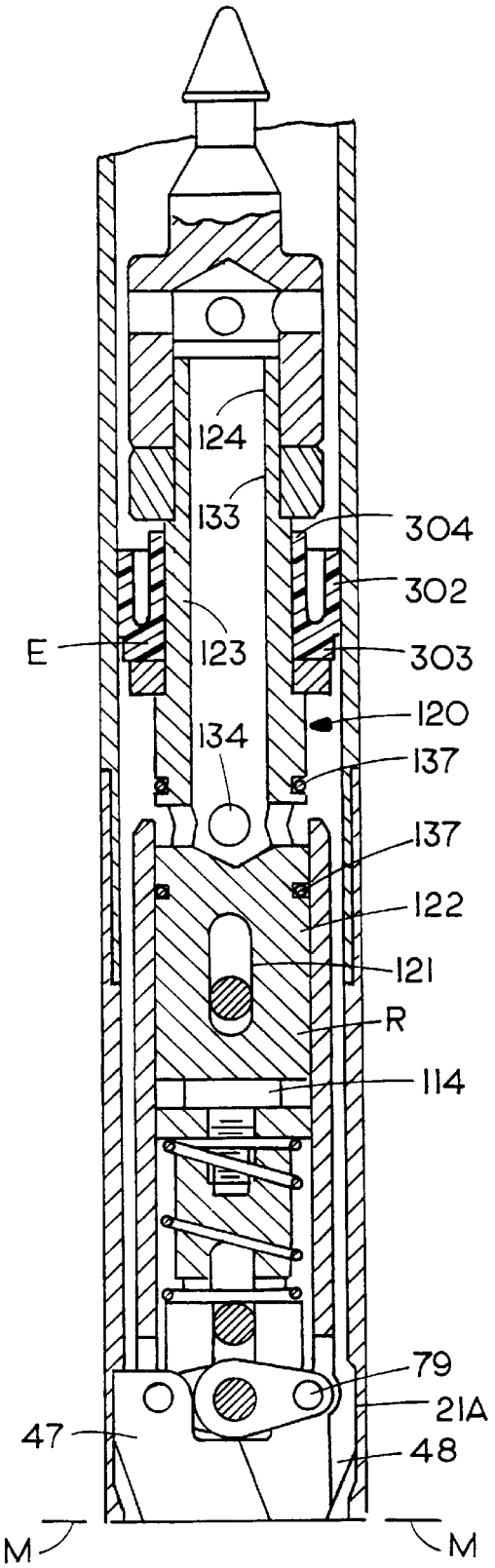
FIGS. 4A and 4B one arranged above the other with the axial center lines aligned and lines M—M and N—N of FIGS. 4A and 4B aligned form a composite longitudinal section through the axial outer end portion of the core barrel inner tube assembly of the second embodiment of the invention with the latches being in a latch seated position.
Figure 4B:
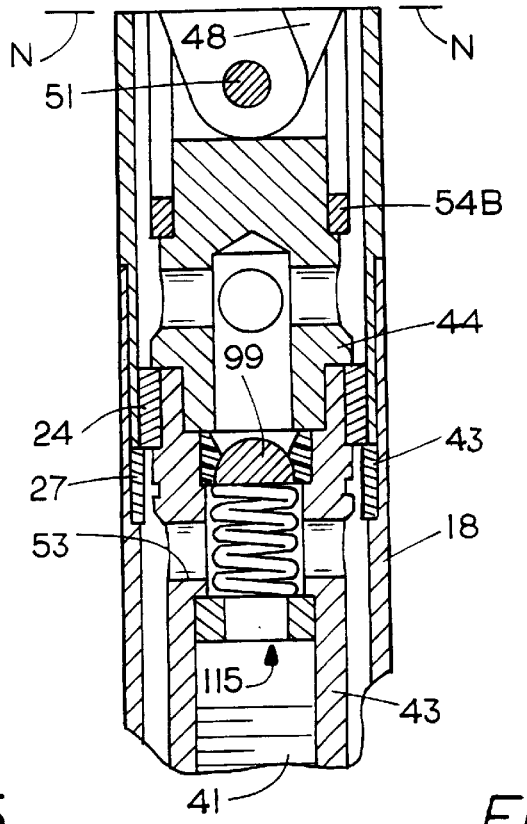
Figure 14:
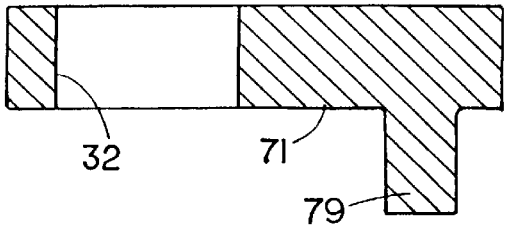
FIG. 14 is a cross sectional view generally taken along the line and in the direction of the arrows 14—14 of FIG. 13.

The latch assembly L also includes a toggle linkage subassembly having generally transversely elongated toggle link members that include toggle links 70, 71 pivotally mounted by pivot link pins 78, 79 to the axial outer ends of portions of the latches 47, 48 respectively for pivotal movement between an overcenter locked position of FIG. 2B and a latch retracted position. Advantageously, each pin may be integrally joined to the generally radially outer end of the respective link (each link member being a single unit having the link and pin) such as shown for pin 79 and link 71 in FIG. 14. The radial inner end portion of each link has an aperture 32, although a transversely elongated slot (not shown) may be used in place of the aperture 32. A horizontally extending retractor pin 58 extended transversely through the apertures 32 and the axially elongated slots 75 of the latch body. The walls defining aperture 32 are sufficiently larger than the radial adjacent part of pin 58 to permit the links moving to the overcentered locked position and a position permitting retraction of the latches such as described herein. The opposite ends of the pin 58 are mountingly retained within opposed apertures (not shown) in the latch retractor tube in fixed axial relationship to the retractor tube and form a lost motion pivotal connection between the latch body, the latches and the latch retractor tube. The axial outward movement of the latch retractor tube relative to the latch body is limited by the pin 80 abutting against the outer edges of the latch body that in part define slots 75 and the axial inward movement is limited by one of the pin 51 abutting against the axial inner edges of the slots 75 and the annular, axial inner edge portion 54A of the latch retractor tube abutting against the shoulder 81 of the latch body. The pin 80 is mounted to the retractor tube in fixed axial relationship to the retractor tube for retracting the latch body when the pin 80 abuts against the outer ends of the slots 75. As the result of providing pin 80 there is a decreased chance of damaging the retractor pin 58 when the inner tube assembly is being retracted. Advantageously, the links and latches respectively are of the same construction and are oppositely faced as in part shown in the drawings.

The transverse central axis of the retractor pin 58 is parallel to the pivot axes of link pivot pins 78 and 79 and transversely therebetween. The pivotal movement of the radial inner ends of the links 70, 71 relative to the latch body in a predominantly inward direction (arrows 90 and 91 respectively) is limited by the retractor pin 58 bottoming on the inner edges of slots 75. When the core barrel inner tube assembly is in its core taking position of FIGS. 2A, 2B and 2C with the latches in their latch seated position, the inner annular edge 54A of the latch retractor tube abuts against the axially outwardly facing shoulder 81 of the latch body, and the central axis of the pin 58 is below the transverse plane (plane perpendicular to the central axis C—C of the drill string, the latch body and latch retractor tube) that contains the axes of the pivots 78, 79. At this time the toggle linkage is in its overcenter latch lock position to prevent the outer end portions of the latches pivoting sufficiently radially inwardly toward one another (at least in part due to the diameters of the apertures 32 to permit the latches moving axially outwardly of the latch recess 21A until the latch retractor tube is pulled axially outwardly to move the retractor pin outwardly of the plane of the central axes of pins 78 and 79. Even though the latches are extendable radially outwardly through the retractor tube slots 83 and the axial inner ends of slots 83 are in part defined by annular portion 54B, the annular portion 54B does not abut against latches to retract the latches from their latch seated position as the retractor tube is retracted.

Figure 7:
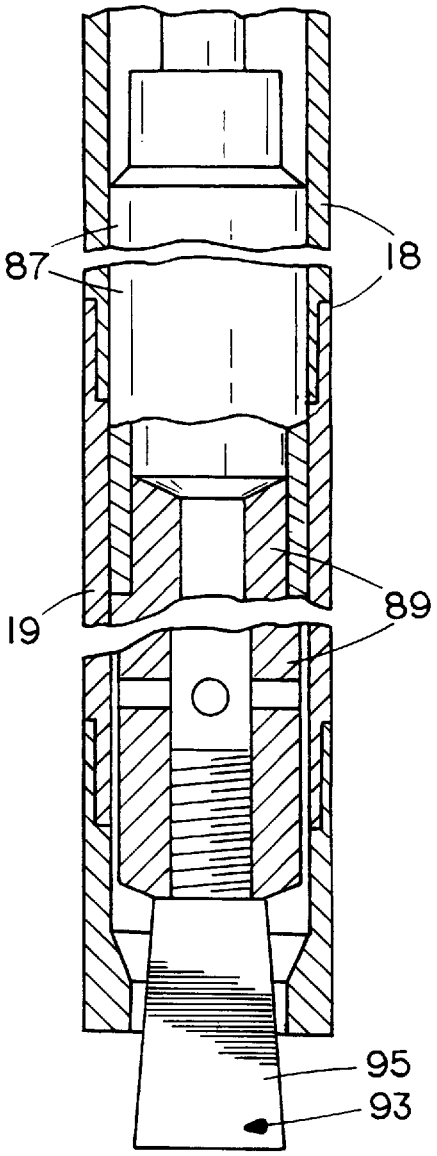
FIG. 7 is an axial cross sectional view of the inner end portion of a third embodiment of the invention which shows a drag bit.

The third embodiment of the invention (see FIG. 7), generally designated 93, includes a latch body, a latch assembly, valving mechanism and a latch retracting mechanism of that may be the same as that disclosed with reference to FIGS. 1A, 1B, 2A and 2B. However, instead of the spindle subassembly 41, there is provided a conventional earth sampler spindle 87 that at its outer end is threadedly connected to the inner body portion 43 of the latch body and at its inner end is threadedly connected to a drag bit mounting sub 89. The sub 89 threadedly mounts a drag bit 95 to extend through and inwardly of the drill bit 11. The sub is of a type that it rotates the drag bit when the bit 11 is rotated.

For retracting the inner tube assembly, there is provided a conventional overshot assembly, generally designated 100, having an overshot body 101 with pulling dogs 103 mounted thereto by a pivot 102. The overshot body has a inner annular edge 101A abuttable against the axial outer edge 54X of the latch retractor tube 54 to limit the axial inward movement of the overshot assembly relative to the inner tube assembly while the inner diameter of the annular edge is slightly greater than the outer diameter of the cylinder part 82 of the spearpoint to which the major base of the frustoconical part 75 is joined. The outer ends of the pulling dogs are resiliently urged apart by a spring 105 and thereby their jaws 103A toward one another. A pin 107 is mounted to the overshot body to extend transversely between the pulling dogs inwardly of the pivot 102 to limit the jaw pivotal movement toward one another.

When lowering the inner tube assembly 15 with the overshot, the latch body annular edge is closely adjacent the retractor tube terminal edge 54X that pulling dog jaws 103A can not move axially outwardly of the juncture of the neck 74 to the spearpoint 73 due to the jaws extending radially inwardly of the maximum diameter portion of the spearpoint and the angles of the adjacent substantially radially extending surfaces. Further, the jaws can not move axially inwardly sufficiently to be spread apart due to the overshot edge portion being abuttable against retractor edge 54X.

In using the apparatus of this invention, for example, the core barrel inner tube assembly 15 of the first embodiment, the assembly 15 is inserted into the outer end of the drill string and as the assembly moves inwardly (axially downwardly), the transverse inner surface of the drill string limits the movement of the latches such that they remain adjacent to their retracted positions of FIG. 1B if being lowered by a wire line overshot assembly, or if free falling through the drill string, the latches abut against the drill string with the pin 80 slightly below the outer edges of the slots 75 but much closer to the outer edges than the inner edges. At this time the pin 55 in abutting against the inner end of slot 72 (if the inner tube assembly is being lowered by an overshot assembly) and/or the latches abutting against the drill string retain pin 58 and thereby pin 80 moving relative slots 75 to prevent the latch retractor tube moving to have its edge 54B abut against the shoulder 81 but do not prevent the latches initially moving toward their latch seated position such as shown in FIG. 1B. As the latch body shoulder ring 27 moves to seat on the drill string landing ring, the latches move axially adjacent to the latch seat whereby the latches can pivot toward and to their latch seated position and are pivoted to their latch seated position as a result of weight of the retractor tube and the overshot coupling member together with the fluid pressure acting on them. That is, the latch retractor tube can move axially inwardly toward and to the shoulder 81. Accordingly, the retractor pin 58 moves axially inwardly toward the shoulder 81 as the latches pivot toward their latch seated position and the latch retractor tube moves to a position under gravity and or fluid pressure to a position to abut against shoulder 81, the outer ends of the latches pivoting radially outwardly of the inner tube assembly central axis C—C to seat in the latch seat as a result of the weight of the retractor tube and overshot coupling member and/or the fluid pressure acting on the retractor tube and the overshot coupling member. It is noted that the length of the slots 75 are such that the retractor pin moves axially inwardly to the axial inner ends thereof even though the latch retractor tube seats on the shoulder 81 and the outer ends of latches abut against the axially extending, radial inner surface that in part defines the latch seat. At this time the movement of the latches results from the links pivoting in the direction of the arrows 90, 91 respectively relative to the outer ends of the latches and continue to pivot in such directions after the pivotal extending movement of the latches is stopped by abutting against the axial wall of the latch seat until the transverse central axis of the retractor pin 58 is below axes of the link pivots 78, 79, the dimensions of the pin 58 relative to the dimensions of the link apertures being such to permit the movement of the latches and the links as, at least in part, indicated above and in U.S. Pat. No. 5,325,930.

When the latch body ring seats on the drill string landing ring, the valve ball descents from the axial outer position of FIG. 1B to seat on the bushing and provide a high pressure that the inner tube assembly is in a core taking position and may be pushed through the bushing as previously indicated. In the event the overshot assembly, if used to lower the inner tube assembly, can not be release in a manner indicated below, this serves to indicate the latches have not properly seated.

When the latches and the toggle link mechanism in the latch seated, toggle mechanism assembly locked position of FIG. 1, an axial outwardly directed force on the latch body urges the latches to move outwardly to abut against the outward annular, generally transverse edge of the latch seat, if not already in such a position. However, the latches can not pivot sufficiently away from their latch seated position to permit the latch body moving axially outwardly of the latch seat in that the axial outward forces on the latches exert such forces on the link pins 78, 79 which results in the links being moved to have the radial inner portions of the links defining the link apertures 32 (link portions most closely adjacent to the respective link pivot) abut against the retractor pin to urge the retractor pin axially inwardly since the central axis of the retractor pin is below the plane of central axes of the link pins. Such inward movement of the retractor pin is limited or prevented by the retractor pin bottoming on the inner edges of the slots 75, and accordingly the latches can not pivot about the latch pivot 51 to have their outer ends sufficiently radially closely adjacent to one another that the latches can move axially outwardly of the latch seat. Thus the latch body remains in the latch seated position even though, for example, the drill bit drills into high pressure gas or water that would otherwise blow the core barrel inner tube assembly out of the drill stem until the central axis of the retractor pin is moved axially outwardly of the transverse plane containing the pivot axes of the pivots 78, 79. The movement of the outer end portions of the latches toward one another sufficiently to permit retraction of the latch body when the latches extend within the latch recess (seat) of the drill stem and the links and retractor pin are in their overcenter latch locked position is limited by the transverse edge portions of the links defining the apertures 32 abut against the retractor pin to prevent the retraction of the latch body until the retractor tube is retracted to move the central axis of the retractor pin remains outwardly of the transverse plane of the link member pins to prevent the latches moving out locked latch seated position.

As the retractor tube moves from its position of FIG. 1A to its position of FIG. 2B, with the retractor tube moving to abut against shoulder 81, the overshot portion 101A also moves inwardly whereby the overshot dogs inner ends are transversely spread by the frustoconical portion 75 to have the outer ends of the pulling dogs move together and the overshot release tube 104 move inwardly relative to the pulling dogs to retain the inner ends of the dogs in their spread apart position. If the dogs do not initially move inwardly to be spread apart to their release position of FIG. 2A, the conventional hammering mechanism (not shown) of the overshot assembly can be applied to the overshot body for moving the dogs downwardly along the frustoconical portion 75 to spread the dogs to their release position. Now the overshot assembly can be withdrawn while the inner tube assembly remains in its latch seated position at the bit end of the drill string.

During the core taking step, the axial inward drill force on the drill string is transmitted through the latches to the pivot member 51 and therethrough to the latch body. Usually, after a core jam or the core receiving tube has taken the desired axial length of core, a conventional and wire line overshot assembly, for example overshot assembly 100, is lowered or allowed to move axially inwardly to couple onto the overshot coupling portion 59. Then, upon retracting the overshot coupling member, the retractor tube is retracted to move the retractor pin outwardly, the link slots being of dimensions to permit axial movement of pin 58 in the latch slots without exerting radial outward forces through the links to the pins 78, 79 as the central axis of the retractor pin is moved from axially inwardly of the plane of the central axes of the pins 78, 79 to a position above the central axes of pins 78, 79 (the inner ends of the links 70, 71 pivoting in the directions opposite of the arrows 90, 91 respectively).

Further retraction of the overshot coupling member results in the movement of the retractor pin relative to link slots (not shown) to abut against end of the respective link slot that is the most remote from pivot 78, 79 for the respective link to continue the movement of the radial inner ends of links whereby the pivots 78, 79 are moved outwardly and radially toward one another to pivot the latches out of the latch seat and toward their retracted position. This permits retracting the latch body and the structure depending therefrom. Now, further retraction of the retractor tube with latches in their retracted position and the retractor pin abutting against the inner edge portions of slots 75 retracts the latch body as the overshot coupling member is moved further axially outwardly.

Even though as disclosed above there is provided a single latch pivot, it is to be understood that there may be provided two latch pivots in parallel relationship with one latch being pivotally mounted by each latch pivot as long as the latch pivots and the link pivots are located such that the links in moving from their latch retracted position to their latch seated position, the links adjacent ends and the retractor pin move to an overcentered latch seated locking position.

Referring to FIGS. 3A, 3B, 4A and 4B, the second embodiment of the core barrel inner tube assembly of this invention, generally designated 110, is of an underground type that can be used for drilling in any direction, including upwardly. The inner tube assembly 110 includes a latch body, a main body portion 44 and an inner portion 43 that advantageously are the same as that of the corresponding parts of the first embodiment. Also, the two way liquid retention valve mechanism, generally designated 115, may be the same as that of the first embodiment as well as the structure connected to the latch body inner portion 43, the latch assembly L and the retraction tube which has been designated 119 for the third embodiment. Similarly, the third embodiment may be used with a drill string and core barrel outer tube such as disclosed with reference to the first embodiment.

The second embodiment includes a spring mount comprising an annular member 117 and a fastener (bolt) 114 threadedly connected to the main body portion 44 to retain the annular member 117 in abutting relationship to the axial outer transverse surface of the latch body main portion 44. An axially extending coil spring 118 is provided on the axial outer part of the main body portion to have one end abut against the annular member 117 and the axial opposite end abut against the pin 80 to constantly resiliently urge the pin and thereby the latch retractor tube toward its latch seated position with at least one of the retractor pin 58 abutting against the axial inner edge of the latch body slots 75 and the axial inner terminal edge portion 54B of the latch retractor tube abutting against the shoulder 81.

For moving the retractor tube axially outwardly, there is provided an overshot coupling assembly, generally designated 120, which is axially movable relative to the latch body due to the provision of retractor pin 55 being extended through an axially elongated slot 121 in the cylindrical portion 122 of the retractor body R. The retractor body also includes a first reduced diameter, axially intermediate portion 123 that has one end joined to the cylindrical portion to extend axially outwardly and a further reduced diameter, axial outer portion 124 joined to the intermediate portion 123 to extend axially outwardly thereof. Mounted to the intermediate portion 123 in surrounding relationship is an annular support 125 that abuts against the axial outwardly facing shoulder formed by the juncture of portions 122 and 123 and an annular seal member E. A spearpoint member 128 is threaded on the outer end portion 124 in abutting relationship to a clamp nut 129 which in turn may be threaded to abut against the shoulder formed by the juncture of portions 123 and 124.

Figure 5:
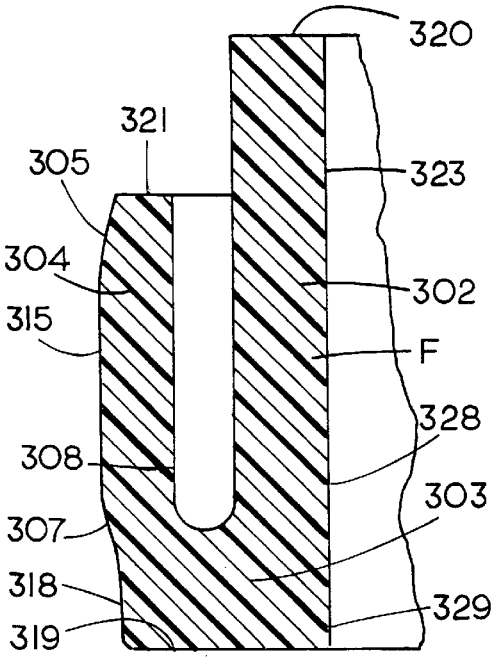
FIG. 5 is an enlarged longitudinal cross sectional view of a part of the fluid seal member of the second embodiment.
Figure 6:
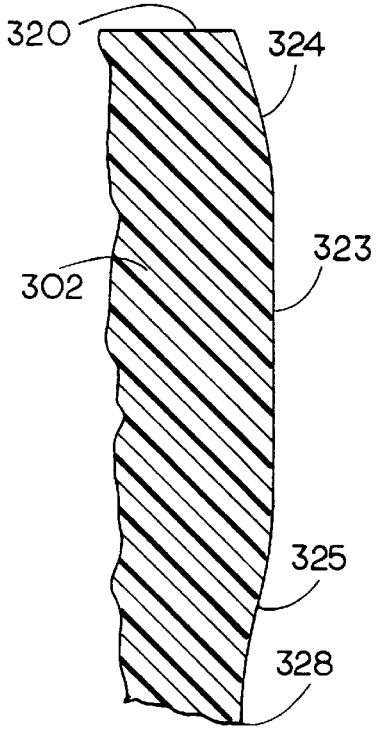
FIG. 6 is a still further enlarged longitudinal cross sectional view of a part of the seal member of FIG. 4.

The seal member E includes a radial inner, axially elongated annular portion 302 bearing against the outer peripheral surface of intermediate portion 123 (see FIGS. 5 and 6). The axial outer, transverse annular edge 320 of the radial inner portion 302 is abuttable against the clamp nut to limit the movement of the seal member axially outwardly relative to the retractor body. The seal member further includes a web 303 joined to the inner end portion of the radial inner portion 302 and to the inner end portion of the radial outer, axially elongated annular portion 304 to provide an axially outwardly opening annulus 308 between portions 302, 304. The radial inner and outer portions 302, 304 have generally planar, axial outer annular edges 320, 321 respectively that are perpendicular to the central axis C—C of the overshot assembly while the radial inner and outer portions 304, 302 and web 303 have coextensive axial inner, annular edges that are generally coplanar and the combination of the inner edges has been designated as 319 which is parallel to edges 320, 321.

The radial outer portion 304 is of a shorter axial length than the radial inner portion 302 and at its outer end has a radial outer annular beveled surface 305 that is tapered radially inwardly in an axial outward direction to intersect edge 321. Further, the radial outer portion 304 has an outer peripheral cylindrical portion surface 315 that extends inwardly from surface 305 to frustoconical surface 307 to at least substantially form a fluid sealing fit with the inner peripheral wall of the drill string. Surface 307 is tapered radially and axially inwardly to intersect with the radial outer cylindrical surface 318 of the radial outer portion 304, is of a smaller diameter than surface 315 and intersects with a rounded corner that in turn intersects with edge 319. The beveled surface 307 extends further outwardly than the inward extent of the annular clearance 308 between the seal radial inner and outer annular portions 302, 304. The tapered (chamfered) surfaces 305, 307 facilitate the seal member moving axially past the drill string rod joints (prevent getting hung up on the joints) while maintaining a fluid seal between the inner peripheral wall of the drill string and the outer peripheral wall of the retractor portion 123.

The inner peripheral wall of the radial inner portion 302 of the seal member includes an axial intermediate cylindrical surface 328 extending a major part of the axial length of the inner portion 302 and an axial outer cylindrical part 323 that is of a slightly smaller inner diameter than that of cylindrical part 328. A frustoconical surface 325 extends from surface 328 to surface 323 while an oppositely tapered frustoconical surface 324 extends axially from surface 323 to the transverse edge 320. The axial lengths of surfaces 324, 325 are much less than that of surface 323 while the diameter of the surface 328 is substantially the same as that of the inner diameter of edge 320. Extending between surface 328 and edge 319 is a radially outwardly and axially inwardly tapered annular surface 329 which is of a relatively short axial length.

The combination of the spearpoint member and the retractor body R has a fluid bypass channel that includes inlet ports 132 opening through the spearpoint to the annular space between the spearpoint member and the radially adjacent drill string rod and to the axially elongated bore 133 that in part is formed in the spearpoint member and in part in the retractor body R. The axial inner end of bore 133 opens to outlet ports 134, the ports 134 opening to the inner peripheral surface of the retractor tube 119 when the latches are in their fully retracted position or are in abutting relationship to the drill string axially outwardly of the latch seat. Grooves in the retractor body mount O-rings 137 on axial opposite sides of the ports 134 to form a fluid seal with the inner peripheral wall of the retractor tube 119 when the latches are in their positions referred to in the preceding sentence. The ports 132 are on axially opposite sides of the seal member than the ports 134.

When the core barrel inner tube assembly 110 is being fluidly propelled to the bit end of the drill string, the latches are retained in abutting relationship to the inner peripheral wall of the drill string as a result of the spring 118 acting through pin 80 and annular member 117 to resiliently urge retractor tube portion 54A toward shoulder 81 and thus through the toggle link mechanism and pin 58. However, since the latches can not move to their fully extended, latch seated position, retractor tube annular edge portion 54A is retained in axial spaced relationship to the shoulder 81 whereby fluid flow to exit through ports 134 is blocked by the inner peripheral wall of the retractor tube. Upon the core barrel inner tube assembly 110 being fluidly propelled axially inwardly to a position the latches are radially opposite the latch seat and the latch body ring seating on the landing ring, fluid under pressure acting on the seal member and the spearpoint member force the retractor member R axially inwardly against the fastener alone and/or in combination with the resilient action of spring 118, the retractor tube moves axially inwardly relative to the latch body until either retractor tube abuts against shoulder 81 or pin 58 abuts against the axial inner edge portion of the slot 75. At this time, the latches are in their latch seated position of FIGS. 4A and 4B with the central transverse axis of the pin 58 being inwardly of the plane of the central axes of the pins 78 and 79 (overcenter latch locking position) and the ports 134 are at least in part axially outwardly of the axial outer terminal edge of the retractor tube to open the fluid bypass channel 132–134 to permit fluid bypassing the seal member E in the drill string.

With the bypass channel 132–134 open, the action of the valving assembly 115 is the same as that described with reference to the valving assembly members 40 of the first embodiment.

When the core barrel inner tube assembly 115 is to be retracted, the initial retraction by an appropriate overshot assembly first moves the overshot coupling assembly 120 axially outwardly relative to the latch body until the inner end of slots 121 abut against pin 55, if not already in such abutting relationship, and then the pin 55 retracts the retractor tube 119 together with the pins 58 and 80. Either the retraction of pin 58 and/or the pin 80 abutting against the axial outer edges of slots 75 results in the latches being retracted and pin 80 in abutting against the axial outer edges of the slots 75 retract the latch body such as described with reference to the first embodiment. It is noted that as the latch body is retracted, the ports 134 open axially outwardly of the radial adjacent part of the retractor tube to permit fluid bypassing the seal member E.

Figure 8:
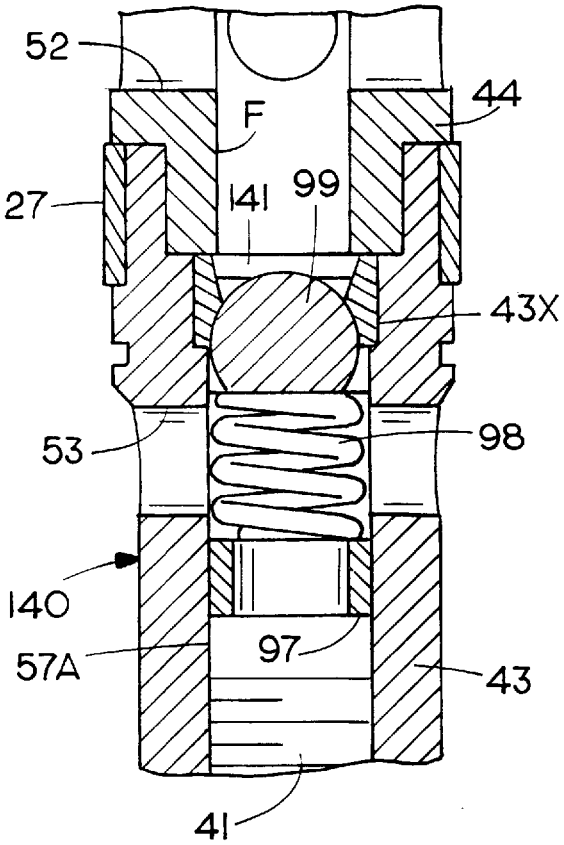
FIG. 8 is a fragmentary, longitudinal cross sectional view of the valving portion of the latch body of the fourth embodiment.
Figure 9:
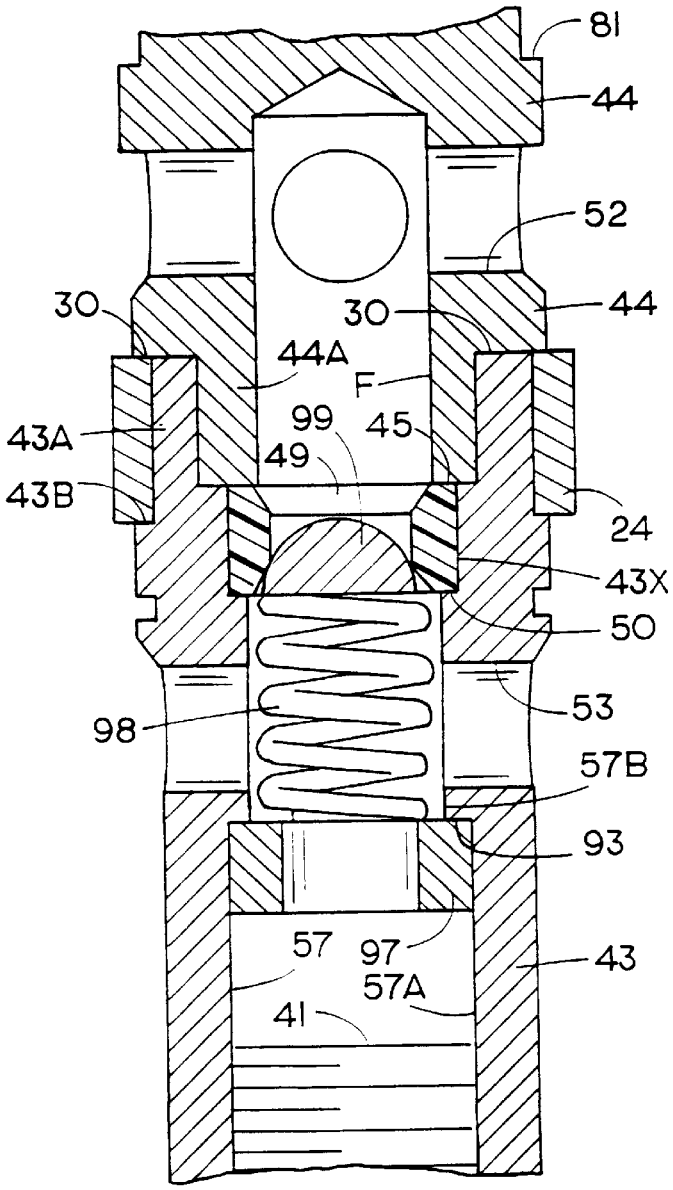
FIG. 9 is an enlarged longitudinal cross sectional view of the valving portion of the latch body of the first embodiment.
Figure 11:
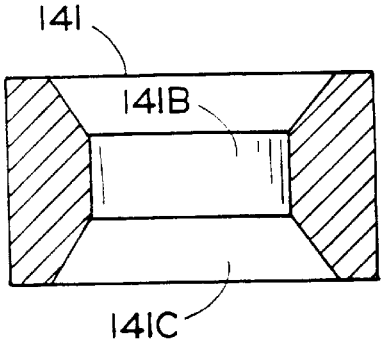
FIG. 11 is an enlarged cross sectional view of the valve seat of a fourth embodiment.

Referring to FIGS. 8 and 11, the fourth embodiment of the invention, generally designated 140, includes latch body portions 43 and 44 that advantageously are of the same construction as that of the first embodiment and mount a latch body landing ring 27 in the same manner as is the annular plug 97 threadedly mounted in the fluid bypass bore portion 57A. The plug 97 is part of the valving mechanism (one way fluid retention valve apparatus) mounted in the fluid bypass channel F as is a bushing 141 mounted in the annular groove that defined by the radial peripheral wall 43X, inner annular edge 45 of the main body portion 44 and the shoulder 50 of the latch body inner portion 43. The bushing 141 in abutting against the annular peripheral wall 43X has an axial intermediate portion 141B that is of a smaller inner diameter than the axial adjacent portions of the fluid channel bore 57. A coil spring 98 acts between plug 97 and a valve ball 99 to resiliently retain the ball in abutting relationship to axial inner frustoconical portion (axially inwardly facing valve seat) 141C to block fluid flow axially outwardly, or severely restrict fluid liquid flow), through bore 57 and to permit fluid flow in the axial opposite direction when the fluid pressure is sufficiently great to permit the ball moving out of fluid sealing relationship with the bushing. Thus, the diameter of the ball 99 is greater than the inner diameter of the bushing portion 141C and the ball is made of a material that it can not be pushed through the bushing without destruction pressures being exerted on the valve ball.

With the fourth embodiment, the bushing (valve seat) 141 can be easily replaced by unthreading the latch body main portion 44 from the latch body inner portion 43, then installing a new valve seat and rethreading latch body portions 43, 44 to one another. Likewise the spring 98 can be replaced by unthreading portions 43, 44 and removing the bushing and taking out the old spring. The replacement spring may have the same characteristics as the old spring or having different characteristics. Thus the spring may be of characteristics to provide only very little resistance to axial inward flow in the bypass channel F, or of a much greater resistance to maintain a desired head of fluid in the drill string even through the bore hole 12 should extend into a very lose earth formation or cavity. Similarly, by unthreading the latch body portions 43, 44, the bushing 141 may be replaced with a bushing 49.

Figure 12:
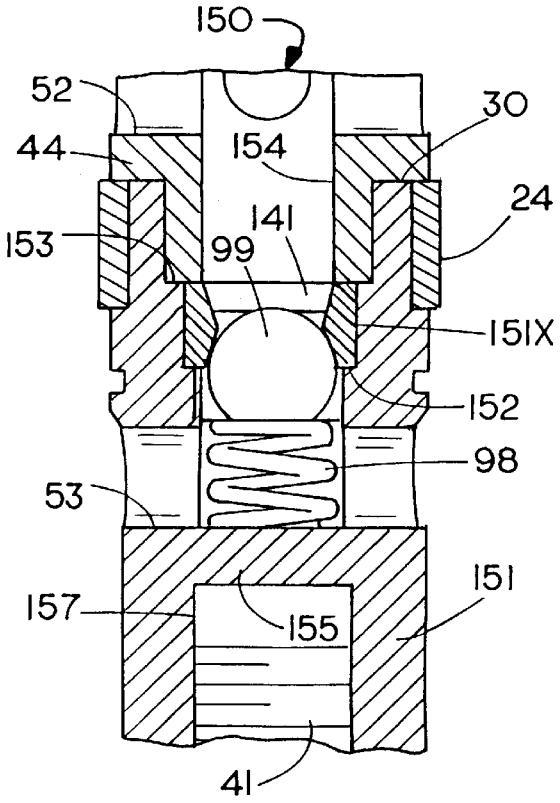
FIG. 12 is a fragmentary cross sectional view of the adjacent parts of the latch body main body and inner body portions of the fifth embodiment of the invention.
Figure 13:
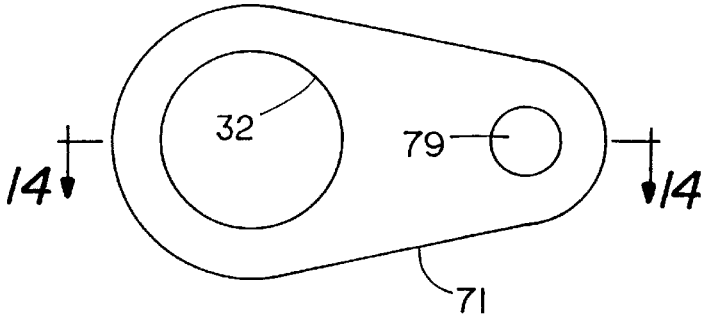
FIG. 13 is a side view of a link member of the latch assembly.

Referring to FIG. 12, the fifth embodiment of the invention, generally designated 150, includes a latch body of the same construction as the first embodiment other than for the latch body inner body portion 151. The inner body portion 151 is the same as inner body portion 43 other than for the part of the fluid bypass channel bore 154 formed in the inner body portion terminates in a transverse imperforated wall portion 155 with the ports 53 opening to bore 154 axially outwardly of the wall portion. Thus, the inner body portion has an annular peripheral wall 151X and an axially outwardly facing shoulder 152 that in conjunction with the main body shoulder (axial inner, annular terminal edge) 153 define an internal groove surrounding and opening to bore 154 to have the bushing 141 seated therein to abut against wall 151X. A coil spring 98 in bore 154 has one end abutting against wall portion 155 and an opposite end abut against valve ball 99 to resiliently retain the valve ball in engagement with the axially inwardly facing valve seat of bushing 141. With the spring seating against the imperforated wall portion, there is provided a permanent cavity in the latch body in which the spring is installed and no adjustment of a plug 97 if such were used. The inner body portion 151 has a threaded bore 157 extending axially inwardly of wall portion 155 and opening through the inner body portion axial inner terminal edge (not shown) for mounting the spindle-bearing subassembly 41.

The valving mechanism of the first, or the second embodiment, or the fifth embodiment may be replaced in the same manner described with reference to the fourth embodiment. Additionally, if desired, either one or both of bushing 49 or 141 and the valve ball may be replaced by unthreading and rethreading the latch body portions. Thus, if desired, the bushing 49 may be replaced with one having greater or less resiliency or a larger or smaller minimum diameter or a valve ball of a larger or smaller diameter if it is desired to provide an open or less restricted fluid bypass channel at a different pump-in fluid pressure.

By providing a spring of characteristics to maintain a predetermined head of fluid (liquid) in the drill string, there will be fluid flow to maintain a stream of fluid to the bit end of the drill string even though fluid does not return to the drilling surface exterior of the drill string due to drilling in broken ground. By using a resilient bushing such as described in the first and second embodiments, the valve ball may move axially outwardly sufficiently relative to ports 52 to permit rapid descent of the core barrel inner tube assembly in a downward direction and once the latch body landing ring seats on the drill string landing ring, the ball moves down to seat on the resilient bushing to block axial inward flow through the bushing or severely restrict fluid flow through the bushing to provide a high pressure signal at the drilling surface. With the pump-in pressure being sufficiently high, the ball is then forced axially inwardly through the bushing.

Each of the embodiments of the invention in drilling in a downward direction may advantageously utilize a valve ball (undersize valve ball) that is of a smaller diameter than the minimum inner diameter of the axial intermediate portion of the respective bushing to permit the valve ball moving axially through the bushing with the ball diameter being sufficiently large to substantially restrict axial inward flow through the bushing, at least while the valve ball is substantially axially centered with reference to the bushing. Thus, as used herein an "undersized valve ball" refers to one wherein with the ball axially and transversely centered with reference to the bushing minimum diameter portion, there is a clearance, desirably annular, between the valve ball and the bushing which permits a leakage stream of liquid passing therebetween. Advantageously, the bushing has an axial outer frustoconical portion that is centered with reference to the latch body central axis and its minor base axially inwardly of its major base to facilitate the valve ball moving axially and transversely to the bushing minimum diameter portion when the valve ball moves axially inwardly in the fluid bypass channel. The valve ball is of a larger diameter than the inside diameter of the axial outer helix turn of the respective coil spring which extends arcuately through at least 360 degrees. As a result, when the drilling direction is downwardly and the inner tube assembly is in its latch seated position with no axial inwardly fluid flow, the coil spring resiliently retains the valve ball extending axially into the bushing such that its maximum transverse cross sectional portion is or nearly radially aligned with the adjacent part of the minimum diameter portion of the bushing.

With the valve ball being of a smaller diameter than the minimum inner diameter of the bushing, during the axial inward movement of the inner tube assembly, the valve ball can move axially outwardly relative to the latch body, including through the bushing if the valve ball is at least in part axially inwardly of the bushing minimum diameter portion, to at least in part be axially outwardly of the ports 52 for permitting the inner tube assembly rapidly descending in a drill string when the drilling direction is downwardly. Further, when the inner tube assembly seats on the landing ring, the valve ball will descend under gravity or axial inward fluid pressure to pass sufficiently axially inwardly to abut against the coil spring to provide a high pressure landing indicator signal at the drilling surface. During the drilling operation, the pumped in drilling fluid will forced the valve ball axially inwardly of the inward facing valve seat against the action of the coil spring to provide the desired fluid flow stream at the bit end of the drill string.

By using an undersize valve ball, there is little impacting of the valve ball on the bushing valve seat in that the valve ball can pass through the bushing without striking the bushing and thus less damage to the bushing. Further, it is easier to maintain the tolerances in the difference in the dimensions between the valve ball and the bushing minimum diameter in that the latch body main body portion and inner body portion are threaded together. Additionally, when the inner tube assembly is in its latch seated position and a valve ball of a larger diameter than the bushing minimum diameter portion is resiliently retained in abutting relationship with the axial inwardly facing valve seat, there is a resistance to the initial retraction of the inner tube assembly in that initially there is a suction created at the drill string and core barrel inner tube assembly landing rings. However, with the undersize valve ball, there is axial inward leakage between the bushing and valve ball which does away with or minimizes such suction effects during the initial retracting force applied to the latches and latch body through the use of an overshot assembly.

The advantages of using an undersize valve ball can be obtained with its usage in the underground inner tube assembly when the drilling direction is in a downward direction.

Even though the bushing may be made of metal if valve ball is not to pass through the bushing, advantageously the bushing is made of plastic, preferable of Nylon with the minimum inner diameter of the bushing and the diameter of the valve are of relative dimensions to prevent the valve ball being force through the bushing. As one example of the invention, but not otherwise as a limitation thereon, the minimum internal diameter of the Nylon bushing may be about 0.850" and the valve ball of a diameter of about 0.87" with or without a spring being provided in latch body bore if the valve ball is to be forced axially inwardly through the bushing by pump-in drilling fluid (liquid) pressure to give a high pressure landing signal at the drilling surface and if the valving mechanism is to be used as a water (drilling fluid) retention valve, a smaller ball (undersize valve ball), for example of a diameter of about 0.84" may be used and pushed axially inwardly of the bushing of a size such as mentioned in this sentence wherein high pump pressure is required to force the valve ball inwardly of the bushing and compress the spring. Alternately, an oversized valve ball of a diameter of about 0.94" may be used with the same bushing referred to in the preceding sentence if the valve ball is not to be passed through the bushing and is to be resiliently retained in abutting relationship to the bushing inwardly facing valve seat by the valve mechanism spring.

With each of the first, second, fourth and fifth embodiments, the latch body landing ring may be easily replaced by unthreading the latch body main body portion from the inner body portion. Likewise any one or more of the valve spring, bushing and valve ball be may replaced or not used with the desired one or more of the valve mechanism elements.

If desired, the valve ball and spring 98 removed, as well as the bushing and annular plug. By providing a fluid bypass channel of a construction of this invention, greater versatility is obtainable with a single core barrel inner tube assembly than other known core barrel inner tube assemblies.

What is claimed is:

1. Drilling apparatus having an axial extending central axis and being movable axially inwardly through a rotatable drill string toward a bit end of the drill string to a position adjacent to the bit end of the drill string to latchingly engage a drill string latch seat and being retractable axially outwardly through the drill string in a direction away from the bit end of the drill string, said drill string having a central axis and a landing shoulder axially adjacent the bit end, comprising a longitudinally elongated latch body having a central axis, an axial outer end portion and an axial inner end portion, a latch assembly mounted to the latch body for movement between a latch seated position for releasably retaining the latch body in the drill string adjacent to the bit end and cooperating with the drill string when the drill string is rotated to rotate the latch body, and a latch release position permitting the latch body being retracted through the drill string, an axially extending latch retractor means for retracting the latch assembly from its latch seated position, said latch retractor means being mounted to the latch body for limited axial movement between an axial outer latch retracted position and an axial inner latch seated position for movement therewith, a drilling tool mounted to the latch body inner portion, said latch body having a shoulder seatable on the drill string landing shoulder and, when seated on the drill string landing shoulder, substantially restricting fluid flow therebetween and a fluid bypass channel having a first port opening to the drill string axially outwardly of the latch body shoulder, a second port opening to the drill string axially inwardly of the latch body shoulder and a bore fluidly connecting the first port to the second port and defining a valve chamber axially intermediate the ports, and valving mechanism mounted in the chamber for controlling fluid flow through the bypass channel, said valving mechanism including a bushing mounted in the valve chamber, said bushing having an axially outwardly facing valve seat and axially inwardly facing valve seat, a valve ball mounted in the chamber, said valve ball and bushing being of relative resiliences that the valve ball is abuttable against the outwardly facing valve seat to block axial inwardly flow through the bore until a sufficiently great axially inwardly fluid force is exerted on the valve ball and then moving axially inwardly through the outwardly facing valve seat and spring means mounted in the chamber axially inwardly of the bushing to constantly resiliently urge the valve ball into abutting relationship with the axially inwardly facing valve seat to block fluid flow axially outwardly through the bushing when the ball is between the spring and the inwardly facing valve seat.

2. The drilling apparatus of claim 1 wherein the fluid pressure to move the valve ball out of abutting relationship to the axially inwardly facing valve seat is substantially greater than that required to force the ball axially inwardly through the axially outwardly facing valve seat.

3. The drilling apparatus of claim 1 wherein the latch body shoulder comprises a landing ring seatable on the drill string shoulder and the inner and outer end portions are threadedly connected together and cooperatively define a transversely outwardly opening external groove in surrounding relationship to said bore to mount said landing ring and an internal groove in surrounding relationship to said bore and opening said bore for mounting said bushing.

4. The drilling apparatus of claim 1 wherein said bore extends sufficiently outwardly of the opening of the first port to the bore to provide a bore outer end portion for having the valve ball move thereinto to permit fluid flow axially from the second bore to the first bore and transversely outwardly through the first port.

5. The drilling apparatus of claim 1 wherein the latch body has axially elongated opposed slots transversely opposite the latches, the slots having axial inner ends and axial outer ends, the latch assembly includes a first and second latch with each having an inner end portion and an outer end portion, pivot means for pivotally connecting the latch inner end portions to the latch body, a first link having a first end pivotally connected to the first latch outer end and a second end, a second link having a first end pivotally connected to the first latch outer end and a second end, a retractor pin pivotally connecting the second ends of the links, the retractor pin axially movably extending within the slots between an inner overcenter latch seated locked position and an axial outer position relative to the latch body for permitting the latches being retracted from their latch seated position, the retractor pin being connected to the retractor means in fixed axial relationship, a second pin extending through said slots axially outwardly of the retractor pin and being in fixed axial relationship to the retractor means, said second pin being axially movable in the slots and, in being moved axially outwardly into abutting relationship to the outer ends of the slots, moving the latch body axially outwardly.

6. The drilling apparatus of claim 5 wherein a spring mount is mounted to the latch body axially outwardly of the second pin and a coil spring is mounted on the latch body in surrounding relationship and has one end portion abutted against the spring mount and an opposite end portion abutting against the second pin to constantly resiliently urge the retractor means axially inwardly relative to the latch body and thereby act through the latch assembly to urge the latch assembly to move to the latch assembly seated position.

7. The drilling apparatus of claim 5 wherein the latch body outer end portion has an axial outer part, the retractor means includes a retractor tube axially slidably extending around the latch body outer part and has the retractor pin and second pin mounted thereto in fixed axial relationship, the retractor tube having an axial outer terminal edge, axially elongated overshot coupling means for retracting the retractor tube, the overshot coupling means including means defining a second fluid bypass channel having a third port, a fourth port axially inwardly of the third port and an axial extending second bore fluidly connecting the third and fourth ports and resilient fluid seal means mounted to the second channel defining means axially intermediate the third and fourth ports and in surrounding relationship to the second bore for forming a fluid seal with the drill string, the overshot coupling means being axially movably attached to the retractor tube for limited axial movement between a position the fourth port is axially inwardly of the retractor tube terminal edge to block fluid flow through the fourth port and an axial outer position the fourth port, at least in part, is axially outwardly of the retractor tube terminal edge, the retractor means including coil spring means having an axial inner end abutting against the second pin and an axial outer end acting against the latch body outer end portion for resiliently urging the second pin axially inwardly and thereby the retractor axially inwardly relative to the latch body to a position the retractor tube terminal edge extends axially inwardly of the fourth ports.

8. Drilling apparatus having a central axis and being movable inwardly through a drill string having a bit end to seat on a drill string landing shoulder and latchingly engage a drill string latch seat, comprising an axially elongated latch body having a shoulder seatable on the landing shoulder, a drilling tool mounted to the latch body to extend axially inwardly thereof, a latch assembly mounted to the latch body for pivotal movement relative to the latch body between a latch seated position seatable in the latch seat to block retraction of the latch body outwardly through the drill string and a retracted position permitting the latch body moving axially outwardly through the drill string, and retractor means mounted to the latch body for limited axial movement relative to the latch body for moving the latch assembly from the seated position to the retracted position, the retractor means having an axial outer overshot coupling portion, the latch body having an axial outer main body portion, an inner body portion removably mounted to the main body portion to extend axially inwardly thereof and a fluid bypass channel in part formed in the main body portion and in part in the inner portion for conducting fluid axially between a location axially outwardly of the latch body shoulder and a location axially inwardly of the latch body shoulder, the fluid bypass channel including a first port opening radially outwardly though the main body portion, a second port opening radially outwardly through the inner body portion and an axial bore in part defined by the main body portion and in part by the inner body portion for fluidly connecting the first and second ports and valving mechanism in the fluid bypass channel for controlling fluid flow through the bypass channel, the main body portion and inner body portion cooperatively defining a radial inner, annular groove surrounding and opening to said bore axially intermediate the first and second ports, the valving mechanism including a bushing removably mounted in said groove and having an axially inwardly facing valve seat, a valve ball mounted in the bore for movement axially inwardly of the groove and a spring in the bore inwardly of the bushing for resiliently urging the valve ball into abutting relationship to the bushing valve seat to restrict fluid flow axially inwardly through the bushing until axial inwardly fluid pressure exerted on the valve ball is above a preselected level.

9. The drilling apparatus of claim 8 wherein the main body portion and the inner body portion cooperatively provide a radially outwardly opening annular groove and the latch body shoulder comprises a landing ring in the last mentioned groove that is seatable on the drill string shoulder.

10. The drilling apparatus of claim 8 wherein the valve ball and the valve seat are of relative diameters to block movement of the valve ball axially outwardly of the bushing.

11. The drilling apparatus of claim 8 wherein the bushing has an axially outwardly facing valve seat and at least one of the valve ball and bushing is of a resiliency to block the passage of the valve ball through the bushing from a position in the bore abutting against the outwardly facing valve seat to restrict fluid flow through the fluid bypass channel in an axial inward direction until the axial inwardly fluid pressure is sufficiently great to force the valve ball through the bushing into abutting relationship to the spring.

12. The drilling apparatus of claim 8 wherein the spring has an axial inner end and the latch body bore is threaded axially inwardly of the opening of the second port to the bore and the valve mechanism includes an annular plug threaded into the bore for abutting against the spring axial inner end.

13. The drilling apparatus of claim 8 wherein the spring has an axial inner end and the inner body portion axially inwardly of the second port in transverse cross section is imperforated to provide an axial terminal bore portion and the spring inner end abuts against the terminal bore portion.

14. The wire line core barrel apparatus of claim 13 wherein the tool comprises a core receiving tube.

15. The wire line core barrel apparatus of claim 13 wherein the tool comprises a drag bit.

16. The drilling apparatus of claim 8 wherein the latch assembly includes a latch mounted for pivotal movement by the latch body between a latch seated position and a retracted position and locking means mounted for movement with the latch and relative thereto for lockingly retaining the latch in a latch seated position after the latch has moved from the latch retracted position to its latch seated position until the retractor means is moved axially outwardly and for retracting the latch from its latch seated position by moving the retractor means axially outwardly after the latch has been locked in its latch seated position, said locking means at least in part being mounted by the latch.

17. The drilling apparatus of claim 16 wherein the main body portion has an axially elongated slot having an axial inner end portion and an axial outer end portion, the locking means includes a retractor pin axially slidably extended in the slot and is limited in axial inward movement relative to the latch body by abutting against the slot inner end portion and a link having a first end pivotally connected to the latch and a second end pivotally mounted to the retractor pin and the retractor means includes a retractor member mounted for limited axial movement relative to the latch body and a transverse member mounted to the retractor member in fixed axial relationship thereto and extended into the main body portion slot for limited axial movement.

18. The drilling apparatus of claim 17 wherein a spring mount is attached to the main body portion axially outwardly of the slot and a coil spring is mounted for abutting against the spring mount and the transverse member for constantly resiliently urging the retractor member axially inwardly relative to the latch body to urge the retractor pin toward the slot inner end.

19. The drilling apparatus of claim 18 wherein the retractor member comprises a retractor tube having the latch body slidably extended thereinto, and the retractor means includes a retractor body having the overshot coupling portion joined thereto and being mounted to the retractor tube for limited axial movement relative thereto, annular fluid seal means mounted to the retractor body in surrounding relationship thereto for forming a fluid seal between the retractor body and the drill string to facilitate fluidly propelling the retractor body toward the drill string bit end, at least one of the retractor and the overshot coupling portion including a second fluid bypass channel having a first port opening to the drill string axially outwardly of the seal means, a second port opening to the drill string axially inwardly of the seal means and a second bore fluidly connecting the second bypass channel ports, the second bypass channel ports being located axially for being blocked by the retractor tube when the latch is in its retracted position and the retractor body is being fluidly propelled axially inwardly and being unblocked when the latch is in its latch seated position.

20. Drilling apparatus having a central axis and being movable inwardly through a drill string having a bit end to seat on a drill string landing shoulder and latchingly engage a drill string latch seat, comprising an axially elongated latch body having a shoulder seatable on the landing shoulder, a drilling tool mounted to the latch body to extend axially inwardly thereof, a latch assembly mounted to the latch body for pivotal movement relative to the latch body between a latch seated position seatable in the latch seat to block retraction of the latch body outwardly through the drill string and a retracted position permitting the latch body moving axially outwardly through the drill string, and retractor means mounted to the latch body for limited axial movement relative to the latch body for moving the latch assembly from the seated position to the retracted position, the retractor means having an axial outer overshot coupling portion, the latch body having an axial outer main body portion, an inner body portion removably mounted to the main body portion to extend axially inwardly thereof and a fluid bypass channel in part formed in the main body portion and in part in the inner portion for conducting fluid axially between a location axially outwardly of the latch body shoulder and a location axially inwardly of the latch body shoulder, the fluid bypass channel including a first port opening radially outwardly though the main body portion, a second port opening radially outwardly through the inner body portion and an axial bore in part defined by the main body portion and in part by the inner body portion for fluidly connecting the first and second ports and valving mechanism in the fluid bypass channel for controlling fluid flow through the bypass channel, the main body portion and inner body portion cooperatively defining a radial inner, annular groove surrounding and opening to said bore axially intermediate the first and second ports and a radial outer, annular groove surrounding said bore axially intermediate said ports, the main body and inner body portions having first shoulders that in part cooperatively define the radial outer groove and a second shoulder and transverse annular edge that in part cooperatively define the radial inner groove, said latch body shoulder being defined by a landing ring removably seated in the radial outer groove to abut against the first shoulders, the valving mechanism including a bushing removably mounted in radial inner groove to abut against the second shoulder and transverse edge and a valve ball mounted in the bore axially intermediate the bushing and one of said port to substantially restrict fluid flow through the bore in one axial direction.

21. The drilling apparatus of claim 20 wherein the main body portion has a reduced diameter part that in part defines the fluid bypass channel and extends into the inner body portion, the reduced diameter part having the main body part first shoulder, and the inner body portion has a axial outer annular part that in part defines the radial outer groove with the reduced diameter part extended thereinto.

22. Drilling apparatus having an axial extending central axis and being movable axially inwardly through a rotatable drill string toward a bit end of the drill string to a position adjacent to the bit end of the drill string to latchingly engage a drill string latch seat and being retractable axially outwardly through the drill string in a direction away from the bit end of the drill string, said drill string having a central axis and a landing shoulder axially adjacent to the bit end, comprising a longitudinally elongated latch body having a central axis, an axial outer end portion and an axial inner end portion, a latch assembly mounted to the latch body for movement between a latch seated position for releasably retaining the latch body in the drill string adjacent to the bit end, and a latch release position permitting the latch body being retracted axially outwardly through the drill string, axially extending latch retractor means for retracting the latch assembly from its latch seated position, said latch retractor means being mounted to the latch body for limited relative axial movement between an axial outer latch retracted position and an axial inner latch seated position, a drilling tool mounted to the latch body inner portion to extend inwardly, said latch body having a shoulder seatable on the drill string landing shoulder and, when seated on the drill string landing shoulder, substantially restricting fluid flow therebetween and a fluid bypass channel having a first port opening to the drill string axially outwardly of the latch body shoulder, a second port opening to the drill string axially inwardly of the latch body shoulder and a bore fluidly connecting the first port to the second port and defining a valve chamber axially intermediate the first and second ports, and valving mechanism mounted in the chamber for controlling fluid flow through the bypass channel, said valving mechanism including a bushing mounted in the valve chamber axially intermediate said ports, said bushing having an axially intermediate minimum diameter portion substantially smaller than the minimum diameter of the bore axially intermediate said ports, a valve ball mounted in the chamber, and a coil spring mounted in the chamber axially inwardly of the bushing, said spring having an axial outer helix turn extending arcuately through an angle of at least 360 degrees and axially closely adjacent to the bushing, said valve ball being of a smaller diameter than the diameter of the bushing minimum diameter portion to permit axial movement of the valve ball through the bushing and of a larger diameter than the inside diameter of the helix turn whereby the movement of the valve ball inwardly of the bushing is restrained by the resilient action of the spring and the valve ball in passing axially adjacent to and at least in part inwardly of the bushing minimum diameter portion substantially restricting axial inward flow through the bypass channel.

23. The drilling apparatus of claim 22 wherein the bushing has an axial outer frustoconical portion with its major base axially outwardly of its minor base and in centered relationship to the latch body central axis and the bore extends axially outwardly of the first port to permit the valve ball moving relative to the latch body axially from extending within the bushing minimum diameter portion to at least in part extend outwardly of the first port to facilitate the fast descent of the latch body in the drill string.

24. The drilling apparatus of claim 22 wherein the latch body has a bearing spindle subassembly second bore axially inwardly of the first bore and an imperforated transverse wall portion axially separating the first and second bores and defining the axial inner terminal end of the first bore and the coil spring has a second end abuttable against the transverse wall.

25. The drilling apparatus of claim 24 wherein the latch body shoulder comprises a landing ring seatable on the drill string shoulder and the latch body inner and outer end portions are threadedly connected together and cooperatively define a transversely outwardly opening external groove in surrounding relationship to said bore to mount said landing ring and an internal groove in surrounding relationship to said bore and opening said bore for mounting said bushing.

26. Drilling apparatus having a central axis and being movable inwardly through a drill string having a bit end to seat on a drill string landing shoulder and latchingly engage a drill string latch seat, comprising an axially elongated latch body having a shoulder seatable on the landing shoulder, a drilling tool mounted to the latch body to extend axially inwardly thereof, a latch assembly mounted to the latch body for pivotal movement relative to the latch body between a latch seated position seatable in the latch seat to block retraction of the latch body outwardly through the drill string and a retracted position permitting the latch body moving axially outwardly through the drill string, and retractor means mounted to the latch body for limited axial movement relative to the latch body for moving the latch assembly from the seated position to the retracted position, the retractor means having an axial outer overshot coupling portion, the latch body having an axial outer main body portion, an inner body portion removably mounted to the main body portion to extend axially inwardly thereof and a fluid bypass channel in part formed in the main body portion and in part in the inner portion for conducting fluid axially between a location axially outwardly of the latch body shoulder and a location axially inwardly of the latch body shoulder, the fluid bypass channel including a first port opening radially outwardly though the main body portion, a second port opening radially outwardly through the inner body portion and an axial bore in part defined by the main body portion and in part by the inner body portion for fluidly connecting the first and second ports and valving mechanism in the fluid bypass channel for controlling fluid flow through the bypass channel, the main body portion and inner body portion cooperatively defining a radial inner, annular groove surrounding and opening to said bore axially intermediate the first and second ports and a radial outer, annular groove surrounding said bore, said latch body shoulder being defined by a landing ring seated in the radial outer groove, the valving mechanism including a bushing removably mounted in radial inner groove and a valve ball mounted in the bore axially intermediate the bushing and one of said port to substantially restrict fluid flow through the bore in one axial direction and an overshot assembly for retracting the overshot coupling portion, the retractor means including a retractor tube having the latch body extended thereinto and an axial outer terminal edge, the overshot assembly having an overshot body that includes an annular terminal portion abuttable against the retractor tube terminal edge to limit axial inward movement of the overshot body relative to the retractor tube, pulling dogs for releasably coupling to the overshot coupling member, said pulling dogs having jaws axially inwardly of the annular terminal portion and being pivotally mounted to the overshot body for movement between a release position and a coupling position, said pulling dogs having axial outer portions, a tubular pulling dog release member mounted on the overshot body for axial movement between an outer position abutting against the pulling dogs outer portions to block inward movement relative to the pulling dogs and an axial inner position relative to the pulling dogs in their release position for retaining the pulling dogs in their release position, the latch body having axially elongated opposed slots transversely opposite the latches, the slots having axial inner ends and axial outer ends, the latch assembly including a first and second latch with each having an inner end portion and an outer end portion, pivot means for pivotally connecting the latch inner end portions to the latch body to mount the latches for movement between a latch release position and a latch seated position, a first link having a first end pivotally connected to the first latch outer end and a second end, a second link having a first end pivotally connected to the first latch outer end and a second end, and a retractor pin pivotally connecting the second ends of the links, the retractor pin being connected to the retractor tube in fixed axial relationship and extended within the slots for axial movement relative to the latch body between a retractor tube axial inner, overcenter latch seated locked position and a retractor tube axial outer position relative to the latch body for retracting the latches from their latch seated position, a second pin extending through said slots axially outwardly of the retractor pin and being in fixed axial relationship to the retractor tube, said second pin being axially movable in the slots and in being moved axially outwardly into abutting relationship to the outer ends of the latch body slots, moving the latch body axially outwardly, the overshot coupling portion being axially attached to the retractor tube for limited axial movement relative thereto and having means for cooperating with pulling dog jaws to retain the pulling dogs in their coupling position when the overshot body annular portion abuts against the retractor tube terminal edge and the latches are in their retracted position and moving the pulling dogs to their release position as the retractor tube with the overshot body portion in abutting relationship moves inward relative to the latch body and the latches move to their latch seated position.

* * * * *